United States Patent [19]

Eylon et al.

[11] Patent Number: 4,534,808

[45] Date of Patent: Aug. 13, 1985

[54] METHOD FOR REFINING MICROSTRUCTURES OF PREALLOYED POWDER METALLURGY TITANIUM ARTICLES

[75] Inventors: Daniel Eylon, Dayton; Francis H. Froes, Xenia, both of Ohio

[73] Assignee: The United States of America as represented by the Secretary of the Air Force, Washington, D.C.

[21] Appl. No.: 617,445

[22] Filed: Jun. 5, 1984

[51] Int. Cl.[3] ..... B22F 3/00

[52] U.S. Cl. ..... 148/133; 148/11.5 P; 148/421; 75/228

[58] Field of Search ..... 148/133, 421, 11.5 P; 75/228

[56] References Cited

U.S. PATENT DOCUMENTS

| | | | |
|---|---|---|---|
| 3,756,810 | 9/1973 | Parris et al. | 148/133 |
| 4,087,292 | 5/1978 | Neal et al. | 148/133 |
| 4,098,623 | 7/1978 | Ibaraki | 148/133 |
| 4,482,398 | 11/1984 | Eylon et al. | 148/133 |

OTHER PUBLICATIONS

Froes et al., "Developments in Titanium Powder Metallurgy", in Journal of Metals, vol. 32, No. 2, Feb. 1980, pp. 47–54.

Froes et al., "Powder Metallurgy of Light Metal Alloys for Demanding Applications", in Journal of Metals, Jan. 1984, pp. 14–28.

*Primary Examiner*—Wayland Stallard

*Attorney, Agent, or Firm*—Donald J. Singer; Charles E. Bricker

[57] ABSTRACT

A method for improving the microstructure of an article made by powder metallurgy of prealloyed titanium powder which comprises beta-solution heat treating the article at a temperature approximately equal to the beta-transus of the equivalent alloy, rapidly cooling the article, annealing the article at a temperature about 10 to 20% below the beta-transus and air cooling to room temperature. The resulting article has a fine alpha plate structure in a matrix of discontinuous beta phase.

7 Claims, 3 Drawing Figures

METHOD FOR REFINING MICROSTRUCTURES OF PREALLOYED POWDER METALLURGY TITANIUM ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of titanium articles fabricated by powder metallurgy to improve the microstructure of such articles.

In general terms, powder metallurgy involves production, processing and consolidation of fine particles to produce a solid article. The small, homogeneous powder particles result in a uniformly fine microstructure in the final product. If the final product is made net-shape by application of isostatic pressing, a lack of texture can result, thus giving equal properties in all directions.

Titanium powder metallurgy is generally divided into two "approaches", the "elemental approach" and the "pre-alloyed approach". With the "elemental approach", the small (−100 mesh) regular grains of titanium normally rejected during the conversion or ore to ingot (commonly called "sponge fines"), are used as starting stock. Alloy additions, normally in the form of a powdered master alloy, are made to these fines. so that the desired bulk chemistry is achieved. The blended mixture is then compacted cold, under pressures up to 60 ksi, to a density of 85–90%. This operation can be carried out either isostatically or with a relatively simple mechanical press. The "green" compact is then sintered to increase density to 95–99.8% theoretical density and to homogenize the chemistry. The cold isostatic pressing is often referred to as CIP. A further increase in density can be achieved by hot isostatic pressing (HIP) the article, which also generally improves the mechanical properties of the article. The combined cold/hot isostatic pressing process is referred to as CHIP.

The CHIP process using elastomeric molds can produce extremely complex shapes, shapes which could never be achieved by forging processes. Caution must be used in applying parts made by this technique in critical components, such as rotating parts, where fatigue behavior is usually very important. Available data indicate that parts made from elemental material are inferior to wrought material in fatigue performance.

With the "pre-alloyed approach", spherical prealloyed powder is used. Spherical powder flows readily, with minimal bridging tendency, and packs to a very consistent density (approximately 65%). This leads to excellent part-to-part dimensional reproducibility. Pre-alloyed powder is generally HIP'd or otherwise hot pressed. Parts made from pre-alloyed powder generally exhibit better fatigue performance than those made of elemental powder, but are somewhat inferior to wrought material.

Heretofore there has been no practical method for refining the microstructure and for improving the fatigue properties of as-produced, net shape titanium articles made by powder metallurgy. While mechanical working can be used on wrought articles to enhance their structure and properties, such treatment is not practical for net shape articles produced from powder.

Accordingly it is an object of the present invention to provide a process for improving the microstructure of articles made by powder metallurgy of prealloyed titanium powder.

Other objects, aspects and advantages of the present invention will become apparent to those skilled in the art after reading the detailed description of the invention as well as the appended claims.

SUMMARY OF THE INVENTION

In accordance with the present invention there is provided a process for improving the microstructure of an article made by powder metallurgy of prealloyed titanium powder which comprises, in combination, the steps of:

a. beta-solution heat treating said article for a relatively brief time;

b. cooling said article at a rate in excess of the air-cooling rate;

c. aging the article at a suitable temperature for a suitable time; and d. air cooling the article to room temperature.

DETAILED DESCRIPTION OF THE INVENTION

The starting stock for powder production contains the desired alloy components. Two methods are presently available for converting titanium alloy product forms to powder: comminution and melting followed by solidification and cooling. The comminution process produces angular particles. For the production of high integrity, near-net shapes, clean, spherical powder is generally required.

Such powder can be prepared by local melting and powder formation, and by atomization of a large mass of molten metal. Exemplary prealloyed powders include Ti-6Al-4V, Ti-6Al-6V-2Sn, Ti-6Al-2Sn-4Zr-2Mo,Ti-5Al-2.5Sn, Ti-2.5Al-13V-7Sn-2Zr, Ti-10V-2Fe-3Al, and Ti-11.5Mo-6Zr-4.5Sn, and the like.

Consolidation of the prealloyed powder may be accomplished using any procedure known in the art. Following consolidation, the formed article may optionally be subjected to an annealing heat treatment. Such treatment is typically carried out at a temperature about 20 to 30% below the beta-transus temperature (in °C.) of the alloy for about 2 to 36 hours in a vacuum or inert environment to protect the surface of the article from oxidation. For example, heat treatment of Ti-6Al-4V alloy is typically carried out between 700°–850° C.

The method of the present invention comprises beta-solution treatment of an article produced by powder metallurgy using prealloyed powder, followed by rapid cooling to room temperature, preferably by quenching, followed by a relatively high-temperature, relatively long annealing heat treatment. The beta-solution treatment is accomplished by heating the article to approximately the beta-transus temperature of the alloy, i.e., from about 5% below to about 10% above the beta-transus temperature (in °C.), followed by rapid cooling. In a presently preferred embodiment, the beta-solution heat treatment is carried out by heating the article to a temperature in the approximate range of 0 to 5% above the beta-transus of the alloy, followed by rapid cooling. The period of time at which the article is held at or near the beta-transus temperature can vary from about 10 minutes to about 240 minutes, depending upon the cross-section of the article. Thinner products will, of course, require a shorter holding time. Cooling is accomplished by quenching the article in a suitable liquid quenching medium, such as water or oil. The article is then annealed by heating to about 10 to 20 percent below the beta-transus temperature of the alloy for about 2 to 36 hours, followed by air cooling to room temperature.

The method of this invention is applicable to prealloyed titanium powder, particularly those alloys in the near alpha and medium alpha+beta classes. An exemplary near alpha titanium alloy is Ti-6Al-2-Sn-4Zr-2Mo, and an exemplary medium alpha+beta alloy is Ti-6Al-4V.

Beta-solution treatment with rapid cooling followed by a long annealing, as described above, results in a fine alpha plate microstructure in a matrix of a discontinuous beta phase.

Figure 1:
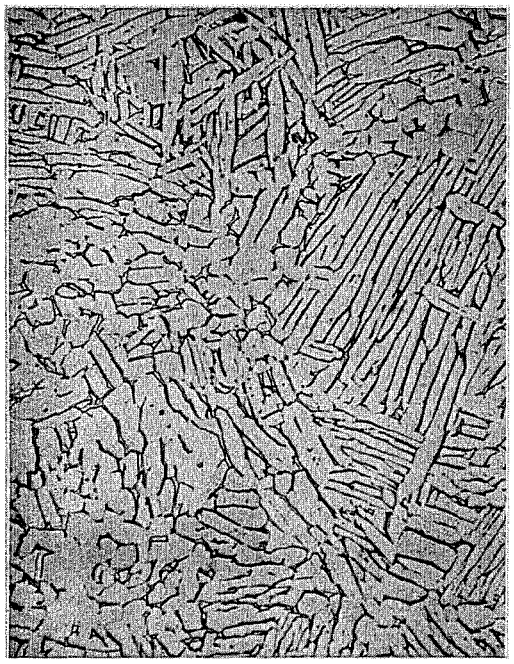
FIG. 1 is a 600x photomicrograph illustrating the microstructure of an article made by powder metallurgy of pre-alloyed Ti-6Al-4V.
Figure 2:
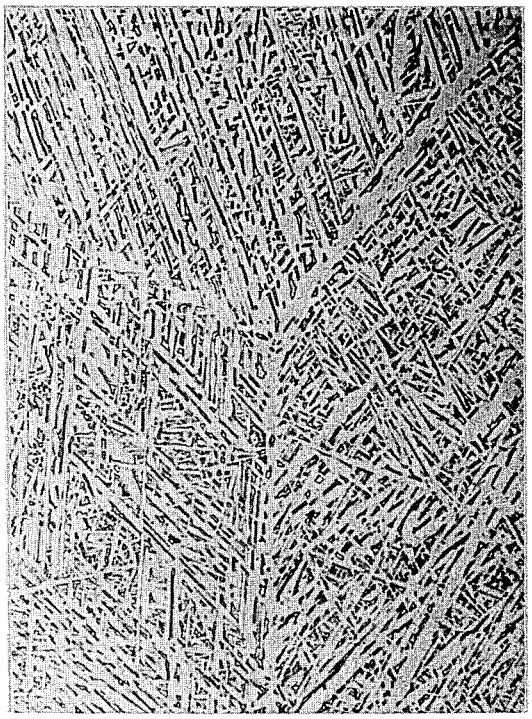
FIG. 2 is a 600x photomicrograph illustrating the microstructure of an article made by powder metallurgy of prealloyed Ti-6Al-4V and thereafter beta-solution heat treated in accordance with the invention.
Figure 3:
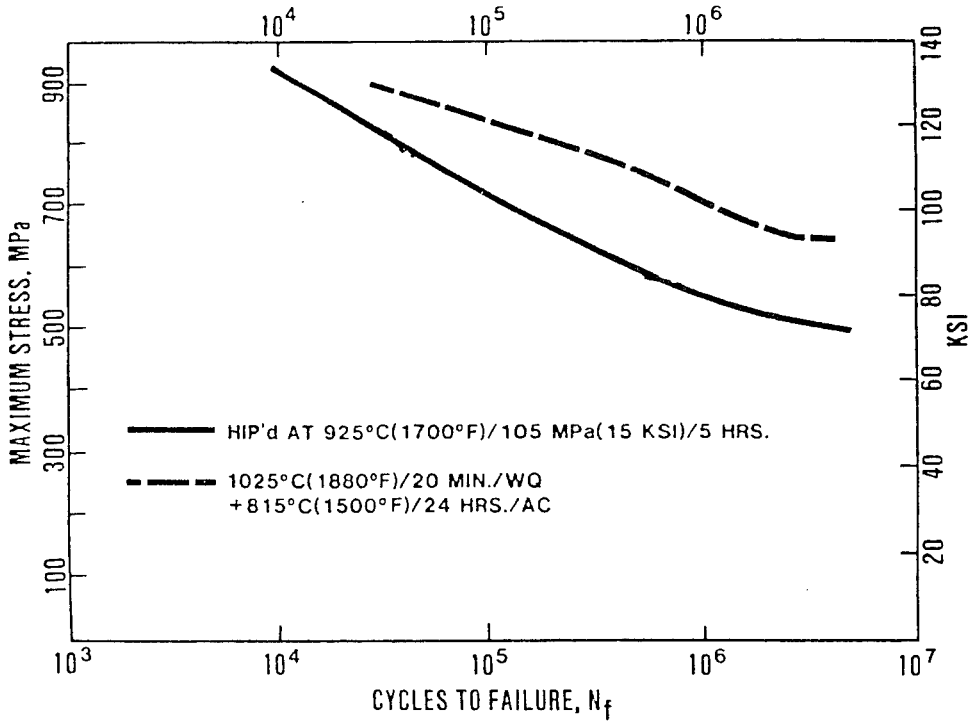
FIG. 3 is a graph illustrating the smooth axial fatigue strength of Ti-6Al-4V prealloyed compacts, both untreated and treated in accordance with the invention.

The benefits of the method of this invention are illustrated in FIGS. 1–3. A typical microstructure of a consolidated article prepared by powder metallurgy of prealloyed Ti-6Al-4V powder is shown in FIG. 1. The structure is a mixture of low and high aspect ratio coarse alpha plates separated by a continuous beta phase.

FIG. 2 illustrates a broken-up alpha plate structure resulting from beta-solution heat treatment in accordance with the invention.

FIG. 3 illustrates the smooth axial fatigue strength of a series of compacts prepared by consolidating prealloyed Ti-6Al-4V powder. The solid line represents the fatigue data of compacts HIP'd at 925° C. (1700° F.) at 105 MPa (15 Ksi) for 5 hours. The broken line represents the increased fatigue strength of compacts which were beta-solution treated as follows: 1025° C. (1880° F.) for 20 minutes followed by water quench to room temperature followed by annealing at 815° C. (1500° F.) for 24 hours then air cooling to room temperature.

The method of this invention is generally applicable to the manufacture of aircraft components, as well as non-aerospace components. This method is particularly applicable to the production of fatigue-resistant titanium alloy articles, such as, for example aircraft engine mount supports, load carrying wing sections and nacelles, turbine engine compressor blades and the like, as well as articles for surgical body implantation, such as hip joints.

Various modifications may be made to the present invention without departing from the spirit and scope of the invention.

We claim:

1. A method for improving the microstructure of an article made by powder metallurgy of prealloyed titanium powder which comprises, in combination, the steps of:

a. beta-solution heat treating said article at a temperature approximately equal to the beta-transus temperature of said alloy;

b. cooling said article at a rate in excess of air cooling to room temperature;

c. annealing said article at a temperature in the approximate range of 10 to 20% below said beta-transus temperature for about 4 to 36 hours; and, d. air cooling said article to room temperature.

2. The method of claim 1 wherein said beta-solution heat treatment is carried out at a temperature ranging from about 5% below to about 10% above said beta-transus temperature for about 10 to 240 minutes.

3. The method of claim 1 wherein said beta-solution heat treatment is carried out at a temperature in the approximate range of 0 to 5% above said beta-transus temperature for about 10 to 240 minutes.

4. The method of claim 1 wherein said prealloyed powder is an alpha+beta titanium alloy.

5. The method of claim 4 wherein said alloy is Ti-6Al-4V.

6. The method of claim 1 wherein said prealloyed powder is a near-alpha titanium alloy.

7. An article of manufacture comprising a component made by powder metallurgy of a prealloyed titanium alloy powder, said article having a fine alpha plate microstructure with a discontinuous beta phase.

* * * * *